United States Patent [19]

Dirksing et al.

[11] Patent Number: 4,892,247

[45] Date of Patent: Jan. 9, 1990

[54] PAPERBOARD CARTON WITH LATCHING PLASTIC LID

[75] Inventors: Robert S. Dirksing; Theodore P. Merz, both of Cincinnati, Ohio

[73] Assignee: The Procter & Gamble Company, Cincinnati, Ohio

[21] Appl. No.: 234,233

[22] Filed: Aug. 19, 1988

[51] Int. Cl.[4] ..... B65D 43/16

[52] U.S. Cl. ..... 229/125.26; 220/334; 220/355; 229/125.08; 229/125.32; 229/160.1

[58] Field of Search ..... 229/125.08, 125.26, 229/125.32, 160.1, 5.5; 220/306, 307, 338, 355, 334

[56] References Cited

U.S. PATENT DOCUMENTS

| | | | |
|---|---|---|---|
| 2,903,173 | 9/1959 | Hopkins | 229/5.5 |
| 3,110,436 | 11/1963 | Wagner | 229/125.26 |
| 3,670,951 | 6/1972 | Smith | 229/125.26 |
| 3,851,812 | 12/1974 | Bittel | 229/5.5 |
| 3,941,300 | 3/1976 | Troth | 229/5.5 |
| 3,944,127 | 3/1976 | Bruke et al. | 229/14 B |
| 4,042,169 | 8/1977 | Burgdorf | 229/125.26 |
| 4,192,434 | 3/1980 | Conroy | 229/125.26 |
| 4,305,524 | 12/1981 | McLaren et al. | 229/125.26 |
| 4,380,447 | 4/1983 | Vanderlugt, Jr. | 229/5.5 |
| 4,693,414 | 9/1987 | Allen | 229/125.02 |

*Primary Examiner*—Gary Elkins

*Attorney, Agent, or Firm*—E. Kelly Linman; John V. Gorman; Richard C. Witte

[57] ABSTRACT

A package comprising a paperboard carton having an open end which is closed by a hingedly connected plastic lid, the lid and the carton together forming a latch to hold the lid in its closed position prior to initial opening of the package and between dispensing cycles. In a particularly preferred embodiment, the plastic lid includes a "U" shaped channel about its periphery, the channel having a projection located on one of the innermost surfaces of the "U". The open end of the paperboard carton includes a folded over flap. Either the flap or the carton sidewall to which it is attached includes an aperture which is complementary in size and shape to the projection on the plastic lid. The lid is maintained in its closed position by entry of the projection on the "U" shaped channel of the plastic lid into the aperture in the paperboard.

14 Claims, 7 Drawing Sheets

PAPERBOARD CARTON WITH LATCHING PLASTIC LID

TECHNICAL FIELD

The present invention has relation to a paperboard carton having a latching plastic lid, said carton being particularly well suited for storing and dispensing powdered and granular materials.

The present invention has further relation to such a package wherein a portion of the latch is formed in the paperboard of the carton and a portion of the latch is formed in the plastic lid.

The present invention has further relation to such a package wherein the plastic lid is hingedly connected to a sidewall of the carton other than the one containing the latch.

Finally, the present invention has relation to such a package which can provide positive closure of the carton when the latch is in its closed position in combination with ease of opening when the consumer wishes to dispense product from the carton.

BACKGROUND OF THE INVENTION

Hinged plastic lids are used on packages for a variety of products. Packages with hinged plastic lids are popular with consumers because they provide a convenient means for opening and closing the packages. Additionally, the plastic lids can improve the protection of the product contained with the package by providing a moisture barrier and good seal. Furthermore, it is common for packages with hinged plastic lids to provide a means to secure the lids in the closed position. Typically, the securing means is a latching system which is molded or formed in mating plastic parts.

The ability to mold or form polymeric materials permits convenience, sealing, latching, and other features to be built into the hinged plastic lids. However, the high cost of polymeric materials relative to paperboard may warrant the selection of paperboard material for the basic containment and delivery functions of a package. Combining a hinged plastic lid with a paperboard carton is a way of providing the convenience and other features of a plastic lid with the economy of a paperboard carton.

One method for applying a hinged plastic lid to a paperboard carton is to first attach a plastic frame to an open end of a carton. The plastic lid which is either integrally or otherwise attached to the frame at the hinge can be closed against the frame for sealing. An example of such an arrangement is disclosed in U.S. Pat. No. 3,944,127 issued to Bruke et al. on Mar. 16, 1976.

The prior art also teaches that a latching system may be incorporated in such plastic frame and hinged lid arrangements for the purpose of securing the hinged plastic lid in the closed position. The latching system may be produced by molding a boss on the lid at a location whereupon closing the lid the boss will snap into a receiving cavity molded into the plastic frame. Unfortunately, the plastic frame is normally as large or larger than the lid and may cost as much as the plastic lid.

A second method for applying a hinged plastic lid to a paperboard carton is to close the lid directly against the edges of an open end of the paperboard carton, thereby eliminating the need and expense of a frame. An example of this arrangement is also disclosed in the aforementioned U.S. Pat. No. 3,944,127 to Bruke et al.

With this arrangement, typically either gravity or friction about the overlapping surfaces of the lid against the carton maintains the lid in the closed position. However, this arrangement, without the benefit of a mating plastic part such as a frame, has not provided the desirable feature of a latching system.

OBJECTS OF THE INVENTION

It is an object of the present invention to provide a latching system for securing a hinged plastic lid in the closed position onto the open end of a paperboard carton without adding a mating plastic part to the paperboard carton.

It is another object of the present invention to provide cartons employing such a latching system at very low cost relative to prior art latching cartons.

DISCLOSURE OF THE INVENTION

In a particularly preferred embodiment, the present invention comprises a plastic hinged lid affixed to an open ended paperboard carton. The open end of the carton is formed by folding integral flaps inwardly so as to present a double thickness of the paperboard stock at the edges of the carton. However, prior to folding the flaps inwardly, a hole is punched into at least one flap so that after the flap is in the folded position, the hole will be located on the interior surface of the carton near the edge of the open end. The hole is preferably on the side of the carton opposite the hinge of the lid. The folded flaps are preferably fastened by gluing or other means to the interior of the carton. The punched hole becomes a shallow cavity near the edge of the open end of the carton. The hinged plastic lid is preferably formed or molded with a "U" shaped channel, about its periphery, which straddles the edges of the open end of the carton. Molded or formed into the interior surface of the "U" shaped channel in a location which corresponds to the shallow cavity in the carton is a boss. With the lid in the closed position, the boss projects into the shallow cavity of the carton. This arrangement serves as a latch to secure the lid in the closed position.

BRIEF DESCRIPTION OF THE DRAWINGS

While the specification concludes with claims that particularly point out and distinctly claim the subject matter regarded as forming the present invention, it is believed that the invention will be better understood from the following description and drawings in which:

DETAILED DESCRIPTION OF THE INVENTION

Figure 1:
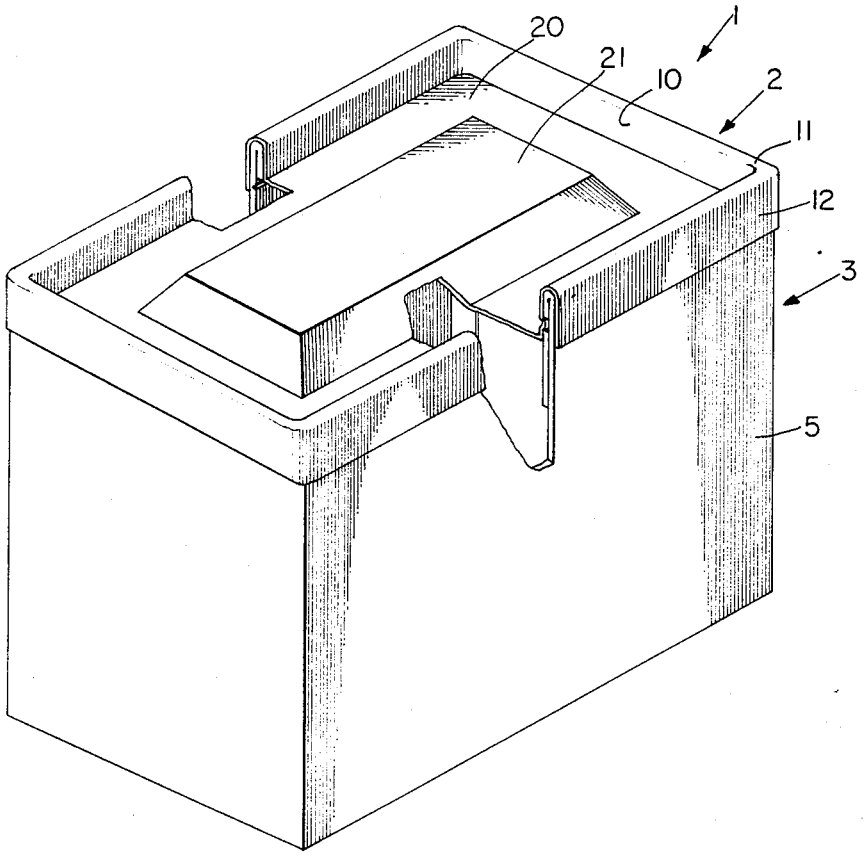
FIG. 1 is a perspective view of a particularly preferred paperboard carton and hinged plastic lid with partially segmented views of the latching system and hinge arrangement.

In FIG. 1 there is shown a particularly preferred package 1 of the present invention. The package 1 comprises a plastic lid 2 and paperboard carton 3. Inner rim 10 and outer rim 12 are joined by frame 11 to form an inverted "U" shaped channel about the border of plastic lid 2. While in the illustrated embodiment, the inner rim 10 and the outer rim 12 are of substantially equal depth, this is not a requirement of the present invention. The inverted "U" shaped channel thus formed is fitted over an open end of paperboard carton 3. Molded or formed within the inner rim 10 of the lid 2 is a general cover portion 20. A raised section 21 is preferably molded or formed into general cover portion 20 for the purpose of stiffening plastic lid 2 and to help support overlying packages.

Figure 4:
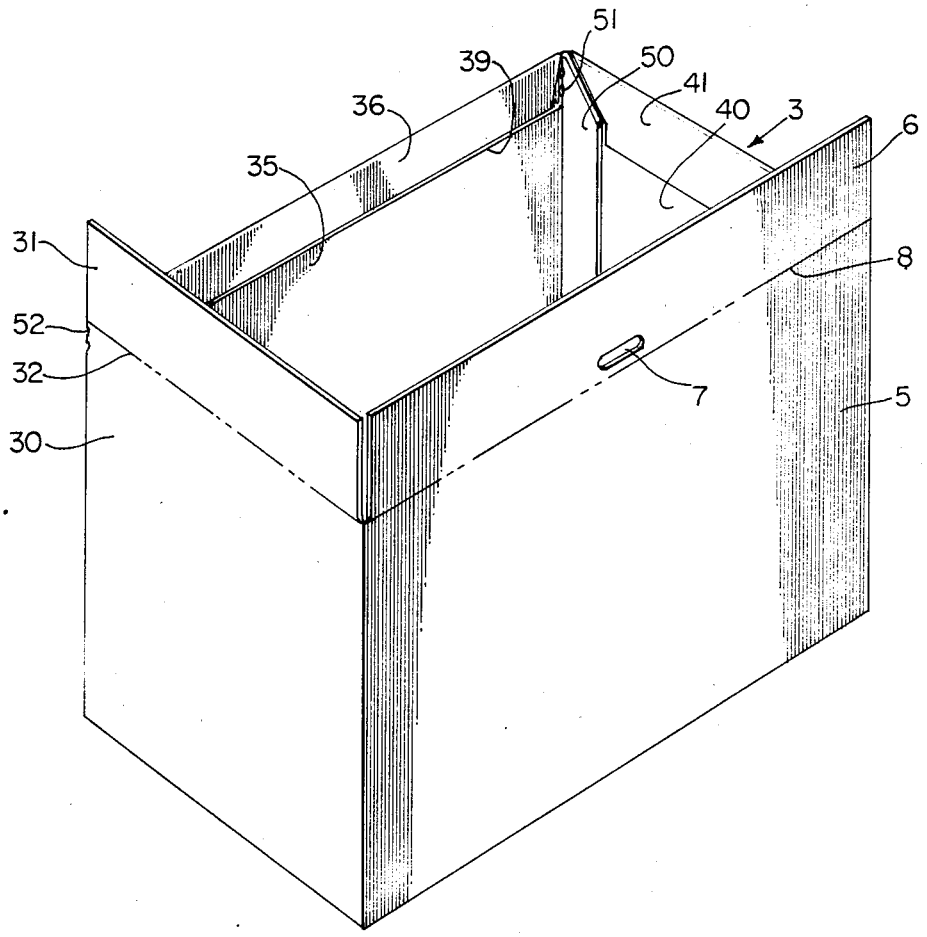
FIG. 4 is a perspective view of a particularly preferred paperboard carton prior to attachment of the plastic lid, said view showing two of the end flaps of the carton prior to folding.

In FIG. 4 there is shown carton 3 in an incompletely folded condition. Flaps 6 and 31 are extensions of sidewalls 5 and 30, respectively. Fold lines 8 and 32 are formed at the junctures between sidewalls 5 and 30 and flaps 6 and 31, respectively. Punched into flap 6 is an aperture or hole 7. Flaps 36 and 41 are shown folded and preferably fastened to the interior surfaced of sidewalls 35 and 40, respectively. Flap 50 is an extension of sidewall 35 and is fastened to sidewall 40 to secure the sidewalls of the carton to one another. In order to complete the formation of the open end of carton 3 in preparation for the attachment of plastic lid 2, flaps 6 and 31 are folded inwardly about fold lines 8 and 32, respectively. In a particularly preferred embodiment flaps 6 and 31 are also fastened to the interior surface of sidewalls 5 and 30, respectively, by means of adhesive (not shown) or the like. Alternatively, the flaps can be folded over and retained in position by the "U" shaped channel on plastic lid 2. When the lid is opened the flaps normally remain in a substantially folded condition. The bottom of carton 3 may be provided in various ways well known in the art, e.g., as by means of folded flaps or a thermoformed plastic base.

Figure 5:
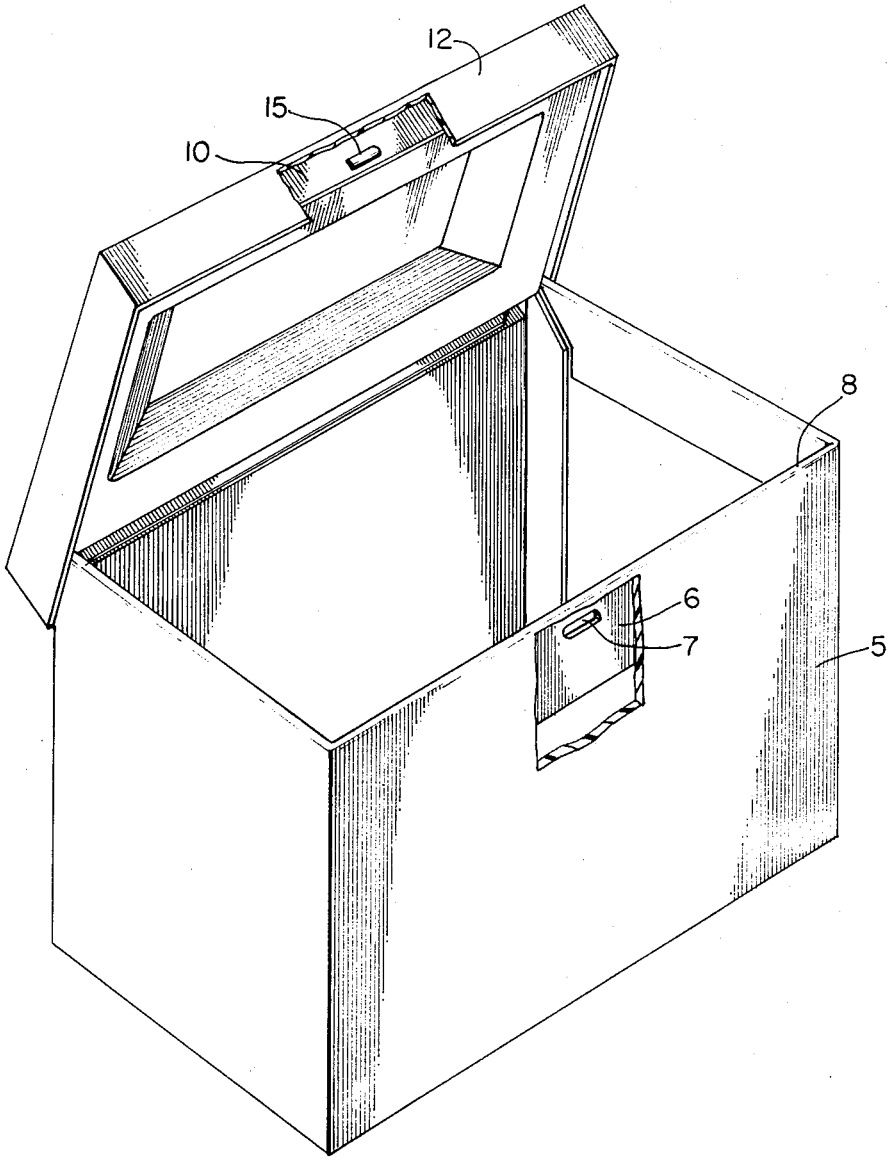
FIG. 5 is a perspective view of the carton of FIG. 4 with a hinged plastic lid in partly opened condition, said figure including partially segmented views of the latching system in the carton and lid.

In FIG. 5, a portion of flap 6 is shown through a partially segmented view of sidewall 5. Flap 6 is folded and fastened onto the interior of sidewall 5. Hole 7 forms a blind cavity which opens to the interior of carton 3. The cavity formed by hole 7 serves as a female receptacle to boss 15 which is located on inner rim 10 of the plastic lid 2, as generally shown through the partially segmented view taken through the outer rim 12 of the lid.

Figure 2:
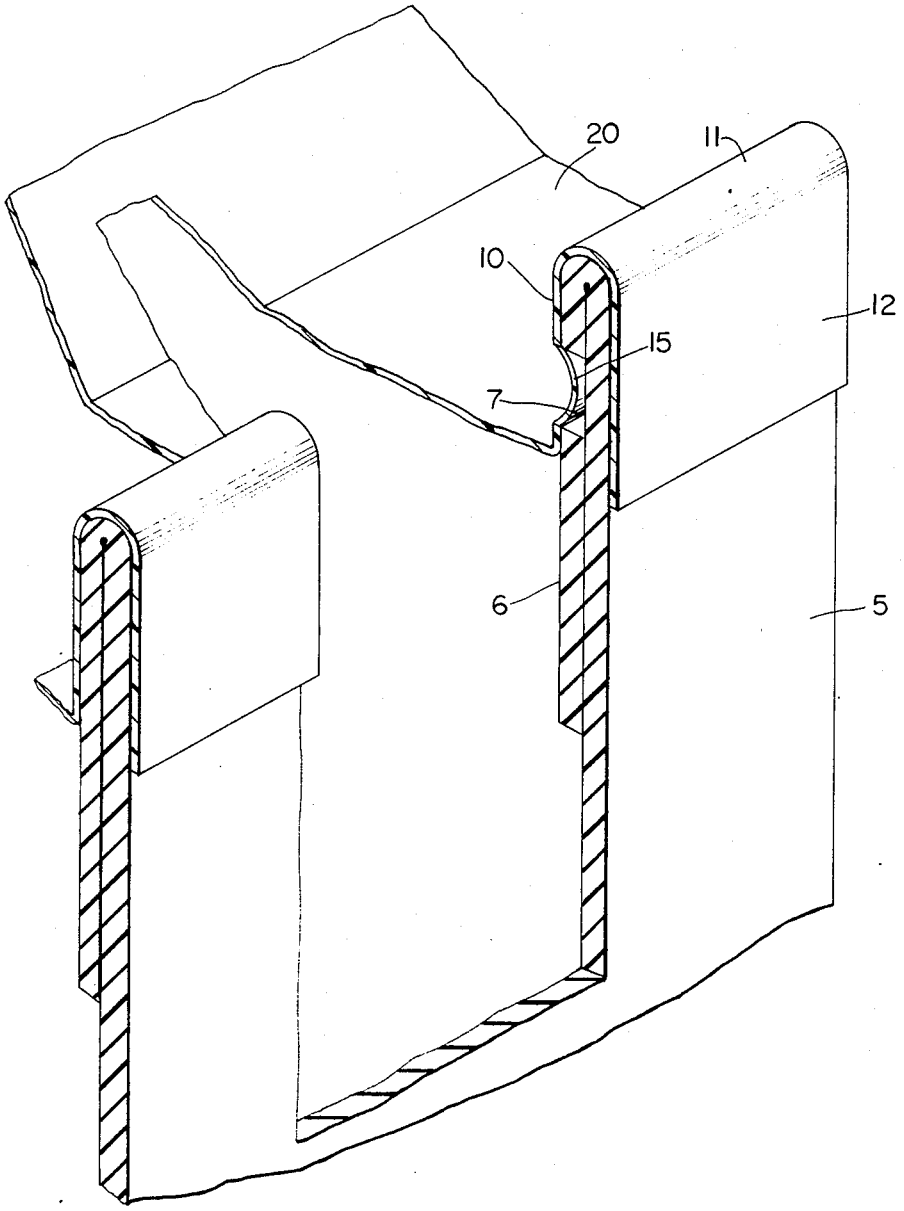
FIG. 2 is an enlarged view of the partial segment of the latching system shown in FIG. 1.

FIG. 2 shows a preferred embodiment of the latch for securing plastic lid 2 in the closed position relative to carton 3. Boss 15 is molded or formed on inner rim 10 of the plastic lid 2 and projects into the cavity formed by hole 7 in flap 6. The interference required to disengage boss 15 from the cavity of hole 7 serves to secure lid 2 in the closed position. The snapping action of boss 15 into hole 7 also serves to signal the user of package 1 that the lid is securely closed.

Although only one latching location is shown in the preferred embodiment, additional or alternative latching locations may be selected depending upon the size of the carton, desired latching force, and general application.

The "U" shaped channel of plastic lid 2 shown in the FIG. 1 embodiment preferably forms a full perimeter seal about the rim of carton 3. However, for the latching system of the present invention to be effective, it is only necessary for the "U" shaped channel to be located at the latch position or positions.

Figure 2A:
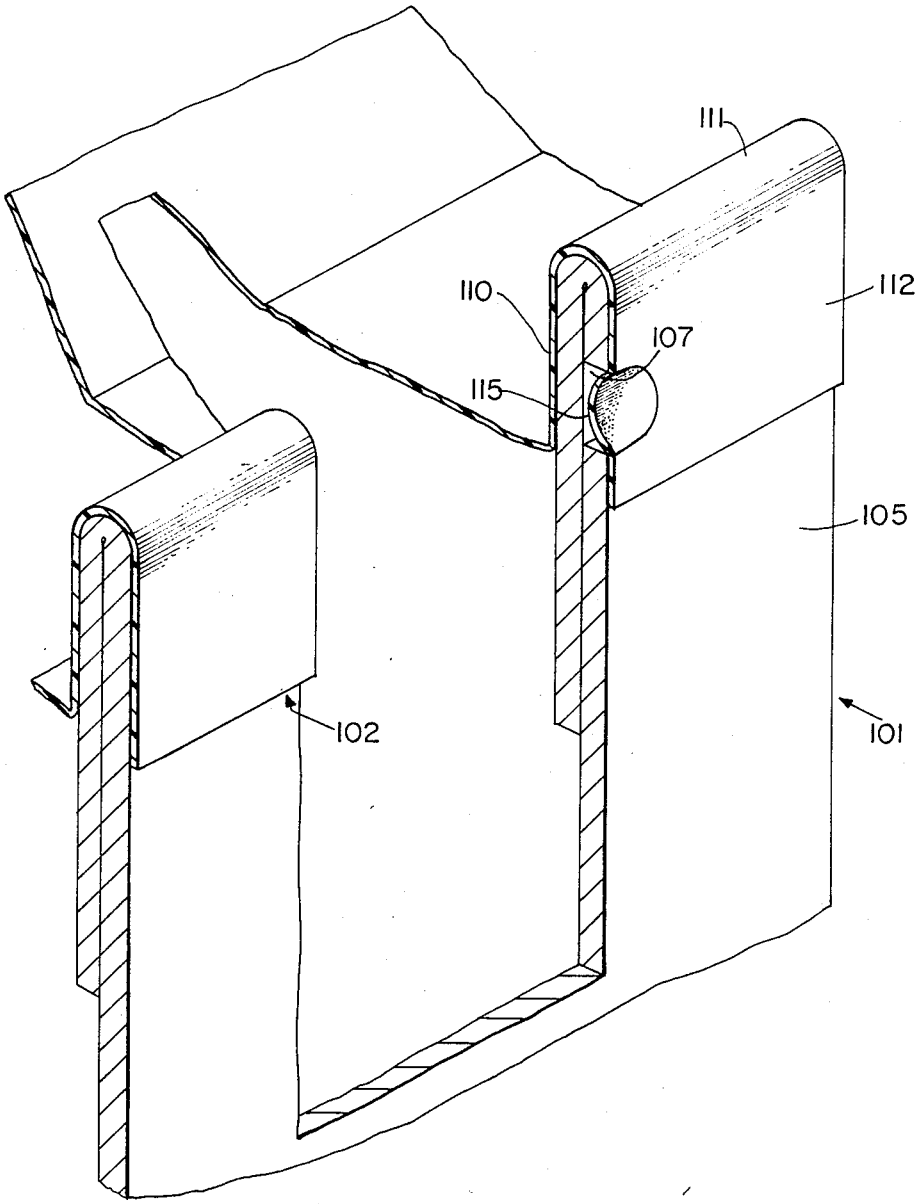
FIG. 2A is an enlarged view of a partial segment of an alternate embodiment of the latching system.

In the alternative embodiment of the latching system of the present invention shown in FIG. 2A, an aperture or hole 107 is provided in outermost carton sidewall 105 rather than in the innermost flap 106, and a boss 115 is formed on the innermost surface of outer rim 112 of plastic lid 102 rather than on inner rim 110. This package embodiment 101 functions in basically the same manner as the package embodiment 1 shown in FIG. 1.

Figure 3:
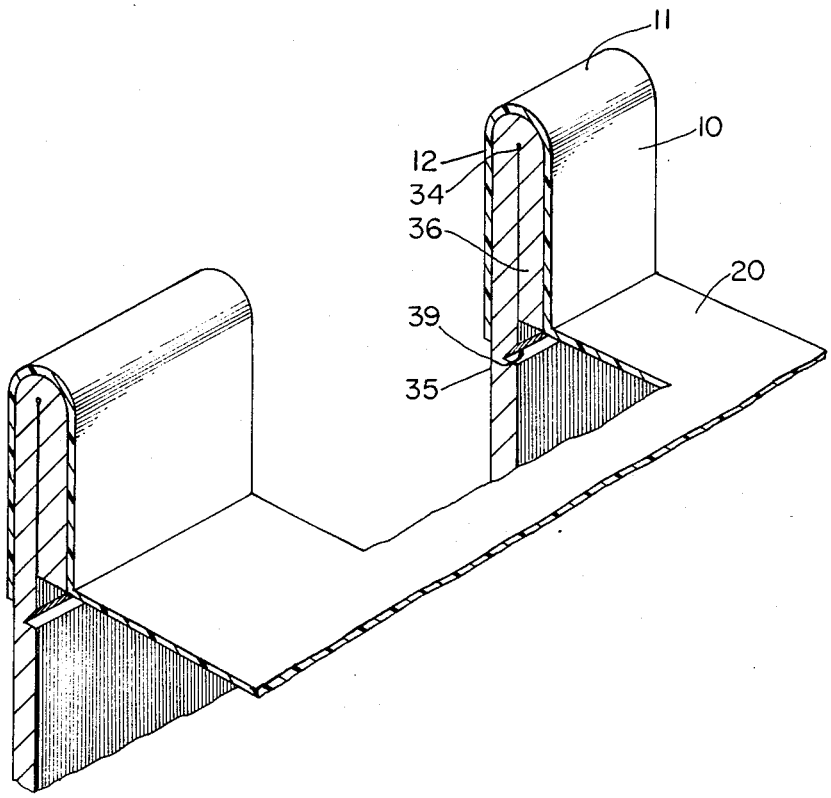
FIG. 3 is an enlarged view of the partial segment of the hinge for the plastic lid shown in FIG. 1.

FIG. 3 is an enlarged view of the partial segment of the hinge for plastic lid 2 shown in FIG. 1. As those skilled in the art will appreciate, many hinge methods are available to provide a pivoting edge for plastic lid 2. However, the FIG. 1 embodiment illustrates a particularly preferred operating principle. Flap 36 is folded about fold line 34 and fastened to the interior surface of sidewall 35. The inverted "U" shaped channel formed by outer rim 12, frame 11, and inner rim 10 of the plastic lid 2 is assembled onto the open end of the carton 5 and fastened onto the folds of sidewall 35 and flap 36 by means of an adhesive (not shown) or the like. Score 39 forms a crease line in sidewall 35 that will serve as the hinge for plastic lid 2 relative to carton 3.

Lines of perforation 51, shown in FIG. 4, join the uppermost corners of sidewall 35 to the uppermost portion of flap 50. A similar line of perforations 52 joins the other uppermost corner of sidewall 35 to the uppermost portion of sidewall 30. Because flap 50 is fastened to sidewall 40, the line of perforations 51 maintains the vertical position of sidewalls 35 and 40 to aid in automated assembly of lid 2 to carton 3. This is likewise true with respect to line of perforations 52 which joins the uppermost portion of sidewalls 35 and 30. However, the lines of perforation 51,52 are sufficiently weak that they permit the uppermost junctures of sidewalls 30, 35 an 40 to break upon first opening of plastic lid 2, thereby forming a hinge at score 39.

Figure 6:
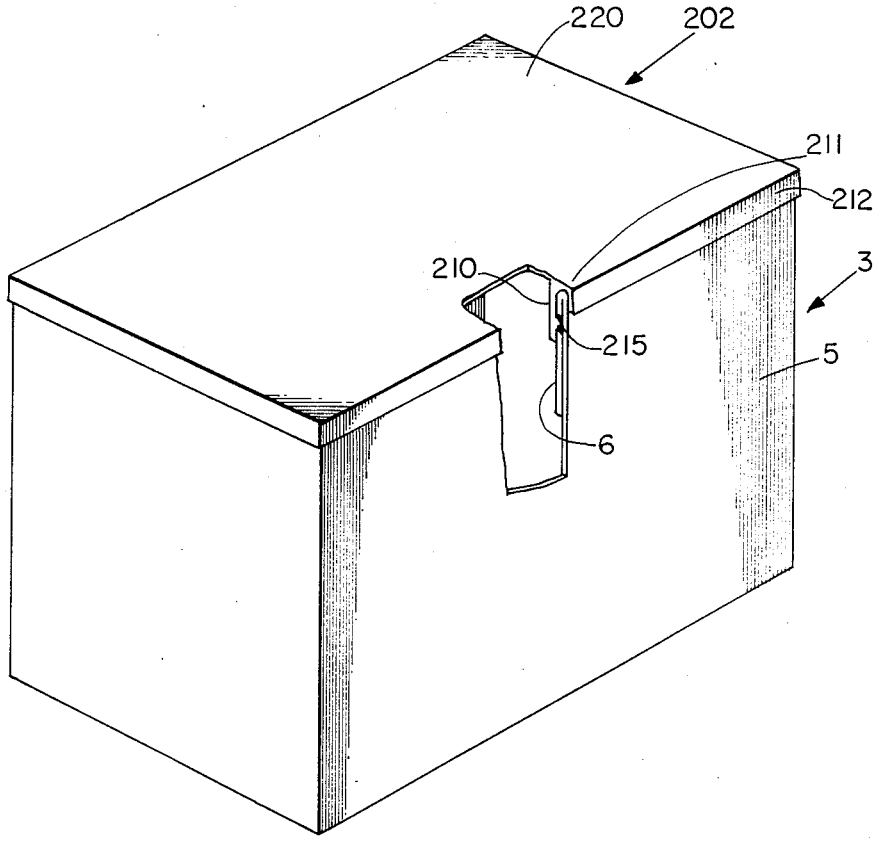
FIG. 6 is a perspective view of an alternate embodiment of the paperboard carton and hinged plastic lid with a partially segmented view of the latching system.

FIG. 6 shows an alternate embodiment of the present invention which may be produced by means of injection molding. Inner rim 210 and outer rim 212, which is shorter in depth, are joined by frame 211 to form an inverted "U" shaped channel about the border of plastic lid 202. The inverted "U" shaped channel thus formed is fitted over an open end of paperboard carton 3. Molded within the inner rim 210 is general cover portion 220. Boss 215 projects from the innermost surface of rim 210 toward the "U" shaped channel. With plastic lid 202 in its closed position, as shown in FIG. 6, boss 215 projects into hole 7 in flap 6. The interference required to disengage boss 215 from hole 7 serves to secure lid 202 in the closed position.

While particular embodiments of the present invention have been illustrated and described, it will be obvious to those skilled in the art that various changes and modifications can be made without departing from the spirit and scope of the present invention, and it is intended to cover in the appended claims all such modifications that are within the scope of this invention.

What is claimed is:

1. A package comprising:

(a) a paperboard carton having an open end and including a multiplicity of interconnected sidewalls, each of said sidewalls having an innermost and an outermost surface, at least one of said sidewalls including a folded over flap at said open end of said carton, said flap including at least one aperture therein;

(b) a plastic lid having a periphery exhibiting a shape generally corresponding to the open end of said paperboard carton, said lid including a "U" shaped channel having an innermost and an outermost surface at its periphery in an area corresponding with said at least one sidewall including said apertured folded over flap, said innermost surface of said "U" shaped channel including a projection which is complementary to said aperture in said flap, said projection being located on the surface of said "U" shaped channel which faces said flap when said lid is in the closed position, said projection being so positioned that it enters into the aperture in said flap when said lid is in its closed position, said lid further including means for hingedly connecting it to one of said sidewalls of said paperboard carton other than the sidewall joined to said flap which includes said aperture, whereby said projection on said "U" shaped flange and said hole in said flap form a detenting latch to hold said lid in its closed position once said projection has entered said aperture.

2. The package of claim 1, wherein said folded over flap including said aperture is secured to said innermost surface of the carton sidewall to which said flap is joined at the fold.

3. The package of claim 1, wherein said "U" shaped channel in said plastic lid extends about the entire periphery of said lid.

4. The package of claim 1, wherein said paperboard carton includes four sidewalls and wherein said open end of said carton is rectangular in cross-section.

5. The package of claim 4, wherein each of said sidewalls includes a folded over flap at said open end of said carton.

6. The package of any of claims 1-5, wherein said aperture in said flap is circular and said projection on said "U" shaped channel exhibits a complementary circular cross-section.

7. The package of claim 6, wherein said "U" shaped channel comprises a frame secured to an inner rim and an outer rim, said inner rim and said outer rim being of substantially equal depth.

8. A package comprising:

(a) a paperboard carton having an open end and including a multiplicity of interconnected sidewalls, each of said sidwalls having an innermost and an outermost surface, at least one of said sidewalls including a folded over flap at said open end of said carton, said sidewall including at least one aperture therein, said aperture in said sidewall being so positioned that it coincides with said folded over flap;

(b) a plastic lid having a periphery exhibiting a shape generally corresponding to the open end of said paperboard carton, said lid including a "U" shaped channel having an innermost and an outermost surface at its periphery in an area corresponding with said at least one sidewall including said aperture, said innermost surface of said "U" shaped channel including a projection which is complementary to said aperture in said sidewall, said projection being located on the surface of said "U" shaped channel which faces said sidewall including said aperture when said lid is in the closed position, said projection being so positioned that it enters into the aperture in said sidewall when said lid is in its closed position, said lid further including means for hingedly connecting it to one of said sidewalls of said paperboard carton other than the sidewall which includes said aperture, whereby said projection on said "U" shaped flange and said aperture in said sidewall form a detenting latch to hold said lid in its closed position once said projection has entered said aperture.

9. The package of claim 8, wherein the folded over flap joined to the sidewall containing said aperture is secured to said innermost surface of said sidewall.

10. The package of claim 8, wherein said "U" shaped channel in said plastic lid extends about the entire periphery of said lid.

11. The package of claim 8, wherein said paperboard carton includes four sidewalls and wherein said open end of said carton is rectangular in cross-section.

12. The package of claim 11, wherein each of said sidewalls includes a folded over flap at said open end of said carton.

13. The package of any of claims 8-12, wherein said aperture in said sidewall is circular and said projection on said "U" shaped channel exhibits a complementary circular cross-section.

14. The package of claim 13, wherein said "U" shaped channel comprises a frame secured to an inner rim and an outer rim, said inner rim and said outer rim being of substantially equal depth.

* * * * *